US010582727B2

(12) United States Patent
Li et al.

(10) Patent No.: US 10,582,727 B2
(45) Date of Patent: Mar. 10, 2020

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Xingbing Zou, Shenzhen (CN); Youli Shen, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 386 days.

(21) Appl. No.: 15/460,229

(22) Filed: Mar. 15, 2017

(65) Prior Publication Data

US 2017/0181476 A1 Jun. 29, 2017

(30) Foreign Application Priority Data

Mar. 21, 2016 (CN) ..... 2016 2 0218364 U

(51) Int. Cl.
*A24F 47/00* (2006.01)
*H05B 3/42* (2006.01)

(52) U.S. Cl.
CPC ..... *A24F 47/008* (2013.01); *H05B 3/42* (2013.01)

(58) Field of Classification Search
CPC ..... A24F 47/008; H05B 3/42
USPC ..... 392/394
See application file for complete search history.

(56) References Cited

U.S. PATENT DOCUMENTS

2015/0034104 A1* 2/2015 Zhou ..... A24F 47/008 131/329
2016/0007654 A1* 1/2016 Zhu ..... A24F 47/008 131/328
2016/0219935 A1* 8/2016 Qiu ..... A24F 47/008
2017/0156408 A1* 6/2017 Li ..... A24F 47/008

FOREIGN PATENT DOCUMENTS

CN 205196999 U * 5/2016 ..... F16K 15/14

* cited by examiner

*Primary Examiner* — Dana Ross
*Assistant Examiner* — Kuangyue Chen
(74) *Attorney, Agent, or Firm* — Cheng-Ju Chiang

(57) ABSTRACT

An exemplary atomizer includes a housing defining a liquid chamber, an atomizing core, and a liquid blocking assembly. The liquid blocking assembly is configured for isolating the atomizing core from tobacco liquid when filling the liquid chamber with the tobacco liquid, and configured for making the atomizing core capable of obtaining the tobacco liquid from the liquid chamber when the atomizer works.

8 Claims, 5 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

An atomizer includes a liquid chamber and an atomizing core in the liquid chamber. In a typical atomizer, the atomizing core is still in communication with the liquid chamber during the process of filling tobacco liquid. Thus, the tobacco liquid may leak from the atomizing core during this process.

What are needed, therefore, are an atomizer and an electronic cigarette using same, which can overcome the above shortcomings.

SUMMARY

An exemplary atomizer includes a housing defining a liquid chamber, an atomizing core, and a liquid blocking assembly. The liquid blocking assembly is configured for isolating the atomizing core from tobacco liquid when filling the liquid chamber with the tobacco liquid, and configured for making the atomizing core capable of obtaining the tobacco liquid from the liquid chamber when the atomizer works.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
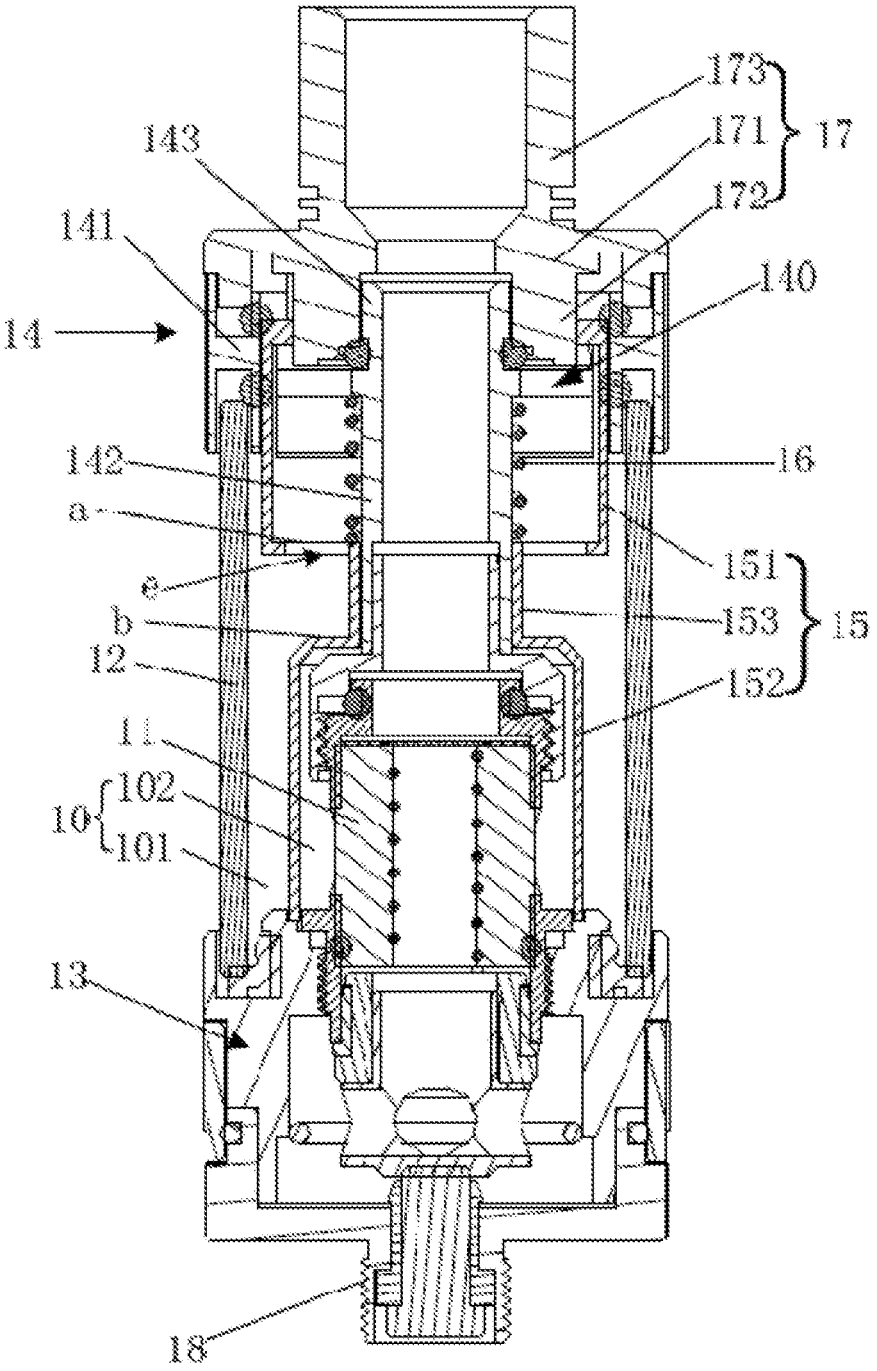
FIG. 1 is a cross-sectional view of an atomizer according to a first embodiment in a first state, including a top cover, a top holder, a liquid blocking assembly, and a bottom holder.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIGS. 1-4, in the present embodiment, the atomizer includes a housing (not labeled), an atomizing core 11, and a liquid blocking assembly (not labeled).

The housing defines a liquid chamber 10. When injecting tobacco liquid into the liquid chamber 10, the liquid blocking assembly is configured (i.e., structured and arranged) for isolating the atomizing core 11 from the tobacco liquid. When the atomizer works, the liquid blocking assembly makes the atomizing core 11 capable of obtaining the tobacco liquid from the liquid chamber.

Quite usefully, the housing includes a first tube 12, a bottom holder 13, and a top holder 14. The bottom holder 13 is arranged at an end of the first tube 12. Referring to FIG. 1, the bottom holder 13 is fixedly and hermetically connected with a bottom end of the first tube 12. The top holder 14 is fixedly and hermetically connected with a top end of the first end. The top holder 14, the first tube 12, and the bottom holder 13 cooperatively form the liquid chamber 10. The atomizing core 11 is arranged in the liquid chamber 10 and fixed on the bottom holder 13.

Quite usefully, the liquid blocking assembly includes a liquid blocking cover 15, an elastic element 16 and a top cover 17. The liquid blocking cover 15 is arranged in the liquid chamber 10, and nests the atomizing core 11. The elastic element 16 elastically abuts between the top holder 14 and the liquid blocking cover 15. The top cover 17 is rotatably arranged in the top holder 14, and threadedly coupled to the liquid blocking cover 15. The liquid chamber 10 includes a first liquid chamber 102 inside of the liquid blocking cover 15, and a second liquid chamber 101 outside of the liquid blocking cover 15. When the top cover 17 is rotated in a first rotation direction, the top cover 17 releases the liquid blocking cover 15, the elastic element 16 drives the liquid blocking cover 15 to elastically abut against the bottom holder 13 or the atomizing core 11, so that the atomizing core 11 is isolated from the liquid chamber 101. When the top cover 17 is rotated relative to the top holder 14 in a second rotation direction, the top cover 17 pulls the liquid blocking cover 15 towards the top cover 17, the liquid blocking cover 15 is separated from the bottom holder 13 or the atomizing core 11, so that the atomizing core 11 is in communication with the liquid chamber 101. Quite usefully, the elastic element 16 is a spring.

Quite usefully, the top holder 14 defines a liquid injecting hole 140. When the top cover 17 is rotated in a first rotation direction relative to the top holder 14, the top cover 17 can be separated from the liquid blocking cover 15, so that the top cover 17 can be detached from the top holder 14. When the top cover 17 is rotated in a second rotation direction relative to the top holder 14, the liquid blocking cover 15 is capable of locking the top cover 17 in the top holder 14, and the top cover 17 seals the liquid injecting hole 140.

Quite usefully, the top holder 14 includes a top holder main body 141, a second tube 142, and a third tube 143. The top holder main body 141 is connected with the other end of the first tube 12. Referring to FIG. 1, the top holder main body 141 is hermetically connected with a top end of the first tube 12. Quite usefully, a sealing ring is provided between the top holder main body 141 and the first tube 12. The second tube 142 extends from the top holder main body 141 towards the atomizing core 11, and is connected to the atomizing core 11. The third tube 143 extends from the top holder main body 141 towards the top cover 17. The top holder main body 141 defines at least two liquid injecting holes 140.

Figure 2:
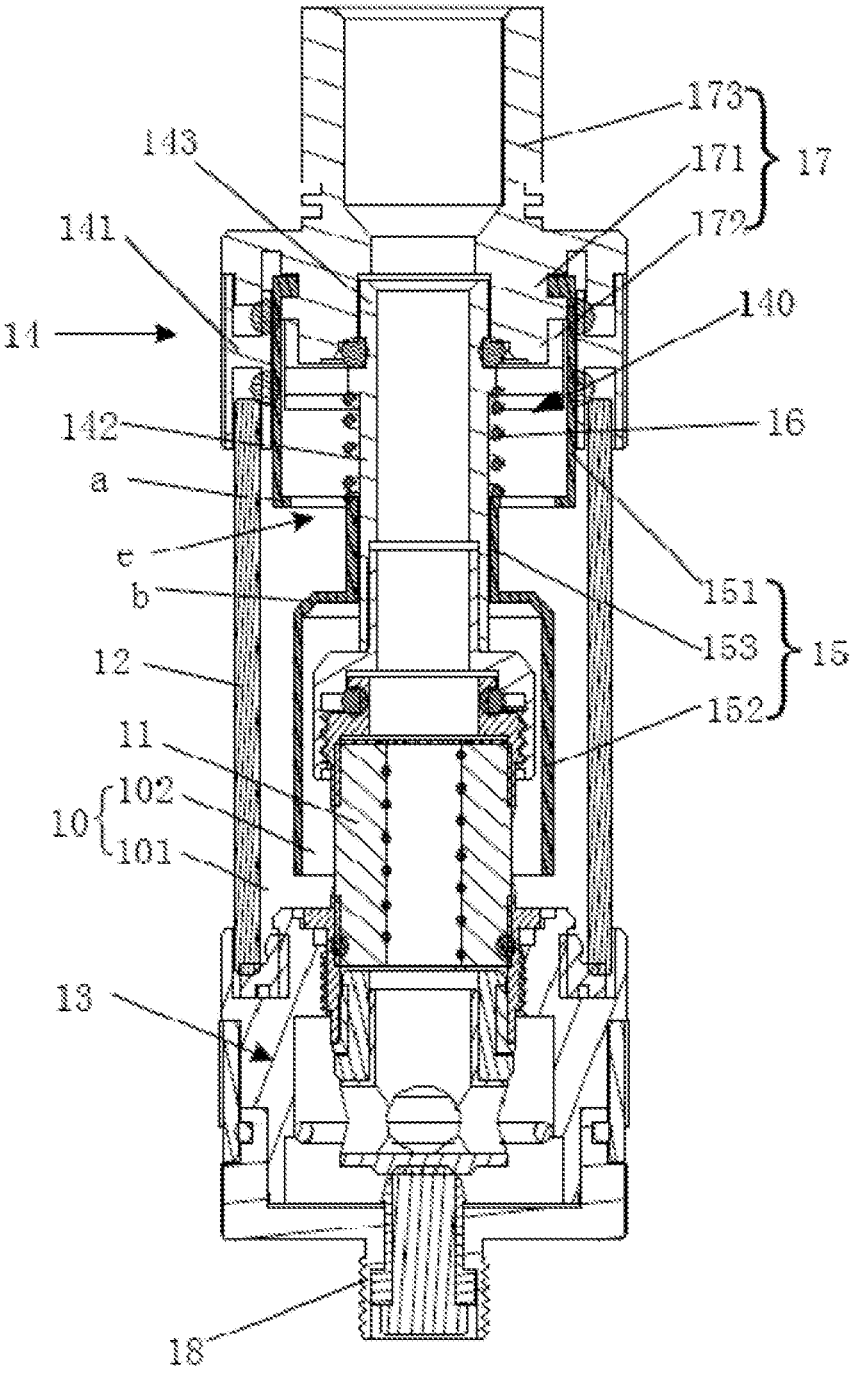
FIG. 2 is a cross-sectional view of the atomizer of FIG. 1 in a second state.
Figure 3:
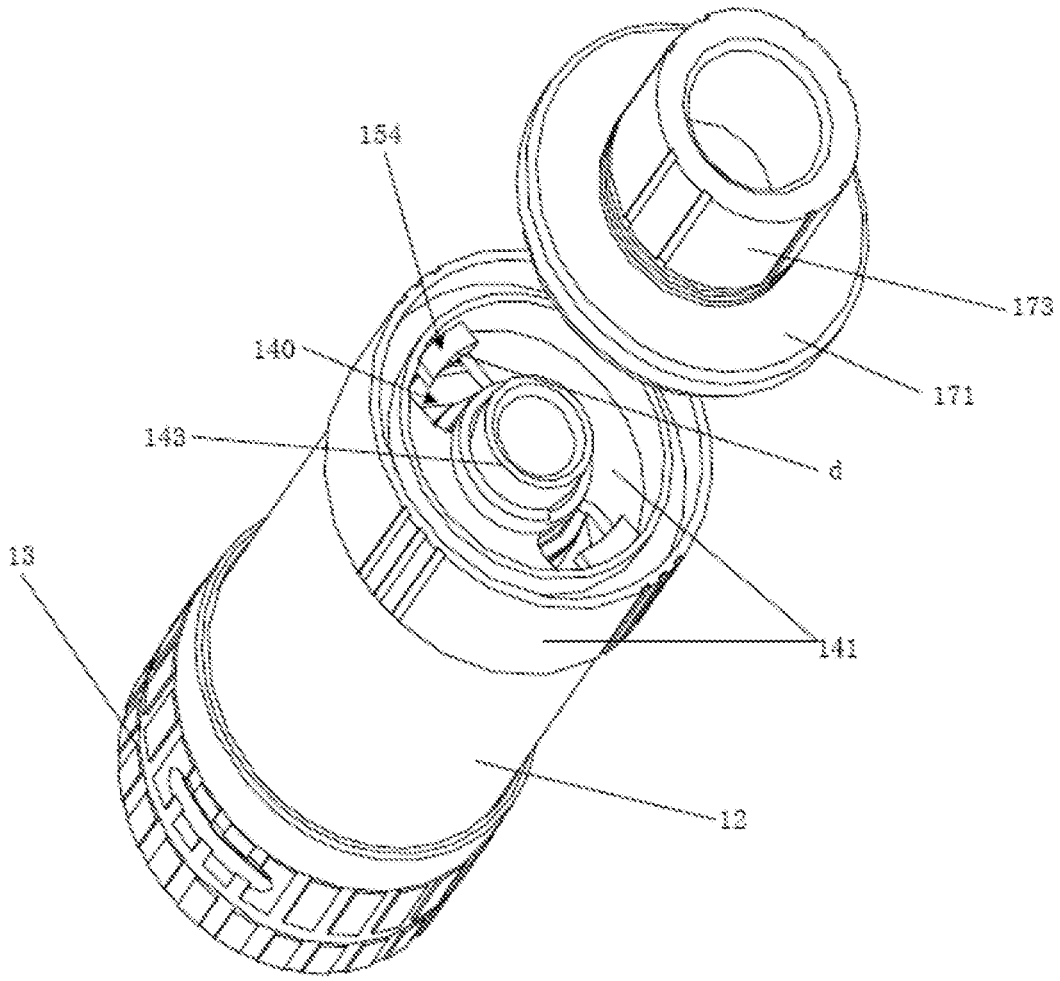
FIG. 3 is a perspective view of the atomizer of FIG. 1 when the top cover is separated from the top holder.
Figure 4:
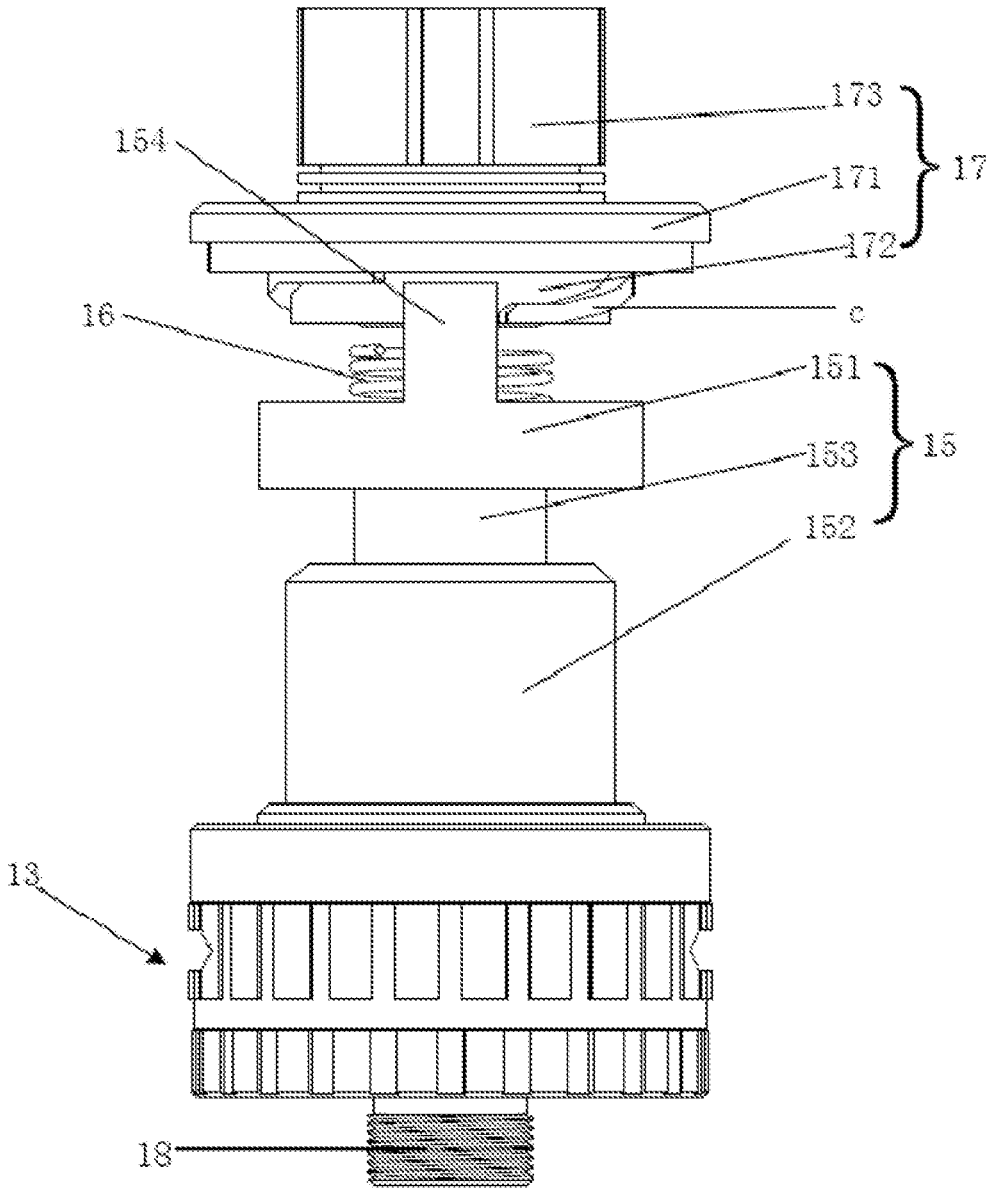
FIG. 4 is an assembled perspective view of the liquid blocking assembly and the bottom holder.

Referring to FIG. 1, when the top cover 17 is detached, the top cover 17 releases the liquid blocking cover 15, and a bottom part of the liquid blocking cover 15 abuts against the bottom holder 13 upon an elastic force of the elastic element 16. In this position, the top cover 17 is opened, tobacco liquid can be filled in, and the atomizing core 11 is isolated from the liquid chamber 101, thus avoiding liquid leakage. Referring to FIG. 2, when the top cover 17 is screwed on, the top cover 17 pulls up the liquid blocking cover 15, a bottom part of the liquid blocking part 15 is separated from the bottom holder 13. In this position, the atomizing core 11 is in liquid communication with the liquid chamber 101, so that the atomizing core 11 can obtain tobacco liquid from the liquid chamber 10.

Quite usefully, the top cover 17 includes a top cover main body 171, a fourth tube 172, and a fifth tube 173. The top cover main body 171 is coupled with the top holder main body 141. Quite usefully, a sealing ring is provided between the top cover main body 171 and the top holder main body 141. The fourth tube 172 extends from the top cover main body 171 towards the top holder main body 141. The fourth tube 172 is configured for receiving the third tube 143. When the top cover 17 is assembled, the third tube 143 is engaged in the fourth tube 172. A sealing ring is arranged between the third tube 143 and the fourth tube 172. The fifth tube 173 extends in a direction away from the top holder main body 141. Quite usefully, the second tube 142, the third tube 143, the fourth tube 172, and the fifth tube 173 are in communication with each other, thus forming an air passage connecting the atomizing core 11 and an external environment.

Quite usefully, the liquid blocking cover 15 nests the second tube 142. The liquid blocking cover 15 includes a first cover body 151, a second cover body 152, and a third cover body 153. The first cover body 151 is adjacent to the top holder main body 141. The second cover body 152 is adjacent to the atomizing core 11. The third cover body 153 connects the first cover body 151 and the second cover body 152. The first cover body 151 includes at least two extending parts 154 at an end facing the top holder main body 141. The extending parts 154 extend through the liquid injecting holes 140, and are threadedly coupled with an outer peripheral surface of the fourth tube 172.

Quite usefully, a diameter of the third cover body 153 is less than those of the first cover body 151 and the second cover body 152. The first cover body 151 includes a connecting end surface a facing the second cover body 152, and the second cover body 152 includes a connecting end surface b facing the first cover body 151. The third cover body 153 connects the connecting end surfaces a and b. The elastic element 16 nests the second tube 142, and is elastically supported between the top holder main body 141 and the connecting end surface a.

Quite usefully, the third cover body 153 slidably sleeves the second tube 142.

Quite usefully, the fourth tube 172 includes a plurality of spiral protruding ribs formed on an outer peripheral surface of the fourth tube 172. The extending parts 154 each include a protruding stage d extends towards the fourth tube 172. The protruding stages d are supported by the spiral protruding ribs c, so that the protruding stages d slide along the spiral protruding ribs c when the top cover 17 rotates relative to the top holder 14.

Quite usefully, the connecting end surface a defines two through holes e corresponding to the two liquid injecting holes 140. The tobacco liquid, which is injected from the liquid injecting holes 140, flows into the liquid chamber 10 via the through holes e.

Quite usefully, a sixth tube body 18 is provided at an end surface of the bottom holder 13 away from the atomizing core 11. The sixth tube body 18 includes a plurality of external screws on an outer peripheral surface. The sixth tube body 18 is configured for connecting with a power supply.

Quite usefully, the first tube 12 is a transparent tube, e.g., a glass tube. The user of the atomizer can see a total amount of tobacco liquid in the liquid chamber 10 through the first tube 12. The first tube 12 may include scales formed thereon.

Figure 5:
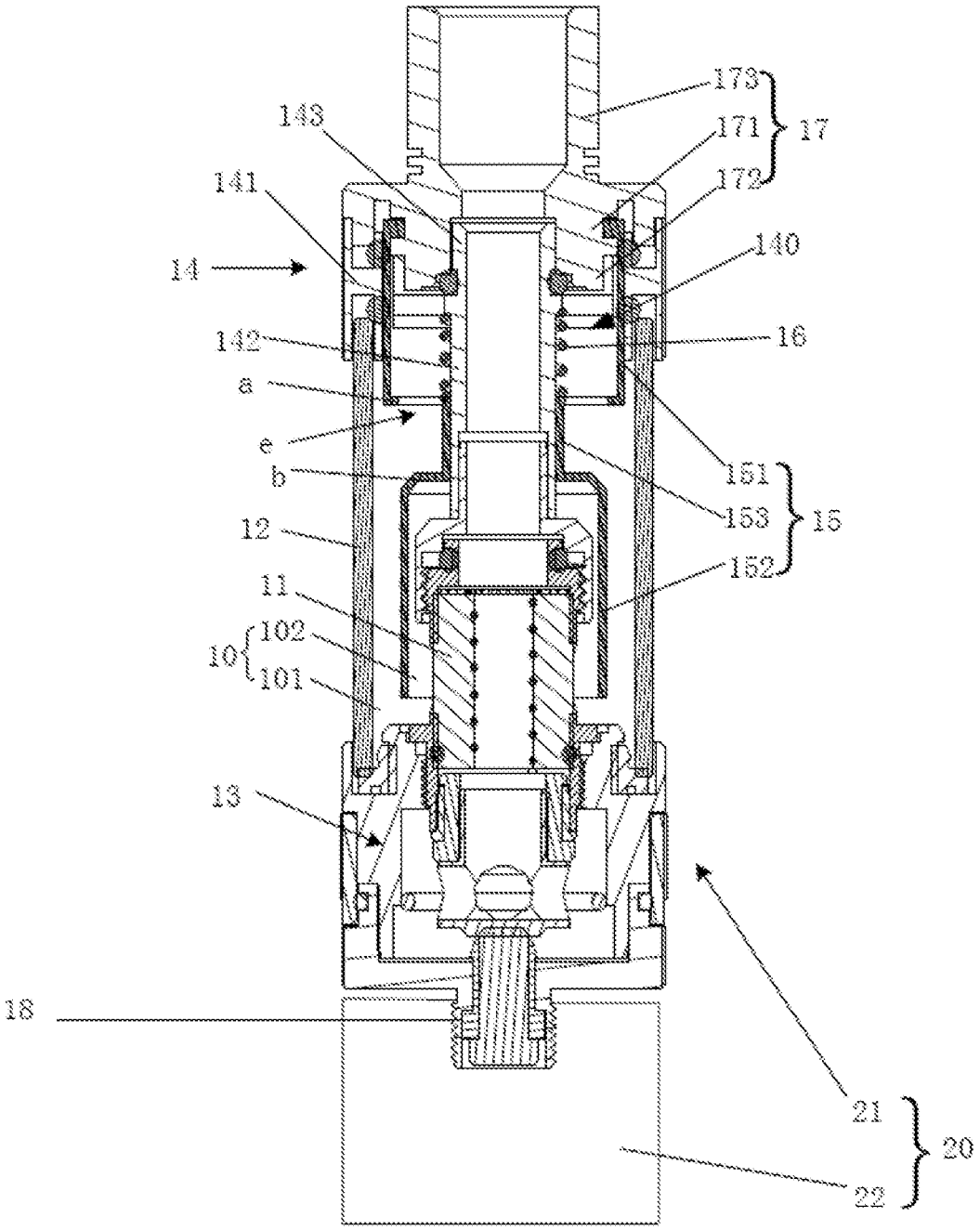
FIG. 5 is a cross-sectional view of an electronic cigarette according to a second embodiment.

Referring to FIG. 5, an electronic cigarette 20 is shown. The electronic cigarette 20 includes an atomizer 21 and a power supply 22. The atomizer 21 is the above atomizer according to a first embodiment. The power supply 22 is connected to the atomizer 21, and configured for supplying the atomizer 21 power. Quite usefully, the power supply 22 is coupled to the atomizer 21 by screw threads via external threads on an outer surface of the sixth tube 18 of the atomizer 21.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a housing defining a liquid chamber, the housing comprising:

a first tube;

a bottom holder arranged at a first end of the first tube;

a top holder arranged at an opposite second end of the first tube, the top holder, the first tube and the bottom holder cooperatively define the liquid chamber;

an atomizing core, the atomizing core arranged in the liquid chamber and fixed on the bottom holder; and a liquid blocking assembly configured for isolating the atomizing core from tobacco liquid when filling the liquid chamber with the tobacco liquid, and configured for making the atomizing core capable of obtaining the tobacco liquid from the liquid chamber when the atomizer works, the liquid blocking assembly comprising:

a liquid blocking cover arranged in the liquid chamber, and nesting the atomizing core;

an elastic element elastically abutting between the top holder and the liquid blocking cover;

a top cover rotatably arranged on the top holder, and threadedly coupled with the liquid blocking cover;

wherein when the top cover is rotated in a first rotation direction relative to the top holder, the top cover releases the liquid blocking cover, so that the elastic element drives the liquid blocking cover to abut against the bottom holder or the atomizing core, and the atomizing core is isolated from the liquid chamber outside of the liquid blocking cover; when the top cover is rotated in a second rotation direction relative to the top holder, the top cover pulls the liquid blocking cover towards the top cover, so that the liquid blocking cover is separated from the bottom holder or the atomizing core, and the atomizing core is in communication with the liquid chamber outside of the liquid blocking cover;

wherein the top holder defines at least two liquid injecting holes; when the top cover is rotated along the first rotation direction relative to the top holder, the top cover can be separated from the liquid blocking cover, so that the top cover can be detached from the top holder; when the top cover is rotated in the second rotation direction relative to the top holder, the liquid blocking cover is capable of locking the top cover in the top holder, and the top cover seals the at least two liquid injecting holes; and wherein the top holder comprises a top holder main body, a second tube, and a third tube, the top holder main body is coupled to the second end of the first tube, the second tube extends from the top holder main body towards the atomizing core, and is connected to the atomizing core, the third tube extends from the top holder main body towards the top cover, the at least two liquid injecting holes are defined in the top holder main body; the top cover comprises a top cover main body and a fourth tube, the top cover main body is engaged with the top holder main body, the fourth tube extends from the top cover main body towards the top holder main body, and the fourth tube receives the third tube; the liquid blocking cover nests the second tube, the liquid blocking cover comprises a first cover body, a second cover body, and a third cover body, the first cover body is adjacent to the top holder main body, the second cover body is adjacent to the atomizing core, the third cover body connects the first cover body and the second cover body; the first cover body comprises at least two extending parts at an end facing the top holder main body, the at least two extending parts extend through the liquid injecting holes, and are threadedly coupled with an outer peripheral surface of the fourth tube.

2. The atomizer according to claim 1, wherein a diameter of the third cover body is less than those of the first cover body and the second cover body, the first cover body comprises a connecting end surface facing the second cover body, and the second cover body comprises a connecting end surface facing the first cover body, the third cover body connects the two connecting end surfaces, the elastic element nests the second tube, and is elastically supported against the top holder main body and the connecting end surface of the first cover body.

3. The atomizer according to claim 1, wherein the top cover further comprises a fifth tube extending in a direction away from the top holder main body; the second tube, the third tube, the fourth tube, and the fifth tube are in communication with each other.

4. The atomizer according to claim 1, wherein the fourth tube comprises a plurality of spiral protruding ribs formed on an outer peripheral surface thereof, the at least two extending parts each have a protruding stage extending towards the fourth tube, the protruding stages are supported by the spiral protruding ribs, and are slidable along the spiral protruding ribs when the top cover is rotated relative to the top holder.

5. The atomizer according to claim 1, further comprising a sixth tube body provided at an end surface of the bottom holder away from the atomizing core, wherein the sixth tube body comprises a plurality of external screws on an outer peripheral surface.

6. An electronic cigarette, comprising:

an atomizer in accordance with claim 1; and a power supply configured for supplying the atomizer power.

7. The atomizer according to claim 2, wherein the third cover body is slidably coupled with the second tube.

8. The atomizer according to claim 2, wherein the connecting end surface of the first cover body defines two through holes corresponding to the at least two liquid injecting holes, and tobacco liquid, which is injected from the at least two liquid injecting holes, flows into the liquid chamber via the through holes.

* * * * *